US008197151B2

(12) United States Patent
Maddy

(10) Patent No.: US 8,197,151 B2
(45) **Date of Patent: *Jun. 12, 2012**

(54) COSMETIC CONTAINER WITH COLOR INSERT

(75) Inventor: Timothy Maddy, Dallas, TX (US)

(73) Assignee: Mary Kay Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/302,737

(22) Filed: Nov. 22, 2011

(65) Prior Publication Data

US 2012/0063834 A1 Mar. 15, 2012

Related U.S. Application Data

(63) Continuation of application No. 11/750,546, filed on May 18, 2007, now Pat. No. 8,083,427.

(51) Int. Cl.
*B43K 5/12* (2006.01)

(52) U.S. Cl. ..... 401/194; 401/98

(58) Field of Classification Search ..... 401/192, 401/194, 88, 89, 49, 52, 98, 202, 213, 247, 401/243, 262, 269
See application file for complete search history.

(56) References Cited

U.S. PATENT DOCUMENTS

| | | | | |
|---|---|---|---|---|
| D114,442 | S | 4/1939 | Dexter | D28/88 |
| 2,595,403 | A | 5/1952 | Neuschaefer | 40/307 |
| 3,317,036 | A | 5/1967 | Cherba | 401/78 |
| D209,340 | S | 11/1967 | Jones | D9/426 |
| 3,677,271 | A | 7/1972 | Luciano | 132/314 |
| 3,990,577 | A | 11/1976 | Delia | 206/457 |
| 3,991,777 | A | 11/1976 | Powers et al. | 132/320 |
| D263,807 | S | 4/1982 | Kingsford | D9/504 |
| D307,646 | S | 5/1990 | Kingsford | D28/76 |
| D343,028 | S | 1/1994 | Chen | D28/87 |
| D349,176 | S | 7/1994 | Litton | D28/76 |
| D350,899 | S | 9/1994 | Vasas | D9/503 |
| D353,689 | S | 12/1994 | Yang | D28/87 |
| D362,925 | S | 10/1995 | Granai | D28/88 |
| D408,593 | S | 4/1999 | Nakano | D28/87 |
| 5,957,607 | A | 9/1999 | Tsai | 401/194 |
| D415,319 | S | 10/1999 | Bakic | D28/76 |
| D419,266 | S | 1/2000 | Gobe | D28/89 |
| D420,466 | S | 2/2000 | Coates et al. | D28/76 |
| D420,766 | S | 2/2000 | Coates et al. | D28/76 |
| D420,767 | S | 2/2000 | Coates et al. | D28/76 |

(Continued)

FOREIGN PATENT DOCUMENTS

| | | |
|---|---|---|
| CN | 2340258 | 9/1999 |

(Continued)

OTHER PUBLICATIONS

"Trade Yellow Pages," Trade Yellow Pages Group: Trade Yellow Pages Corp., Taiwan Trade Pages Corp., World Phone Limited, pp. 1074, 2001.

(Continued)

*Primary Examiner* — David Walczak
(74) *Attorney, Agent, or Firm* — Fulbright & Jaworski L.L.P.

(57) ABSTRACT

A container for holding cosmetics which has a colored insert configured to indicate the color of a cosmetic product contained in the container. A method of replacing a lipstick cartridge comprising replacing a lipstick cartridge with a replacement lipstick cartridge and inserting a replacement colored insert in the cap of the lipstick container.

10 Claims, 4 Drawing Sheets

U.S. PATENT DOCUMENTS

| | | | | |
|---|---|---|---|---|
| D421,156 | S | 2/2000 | Coates et al. | D28/76 |
| D421,819 | S | 3/2000 | Heeter et al. | D28/85 |
| D422,902 | S | 4/2000 | Kikuchi | D9/689 |
| D428,212 | S | 7/2000 | Gavin | D28/85 |
| D431,324 | S | 9/2000 | Hirato et al. | D28/76 |
| D436,225 | S | 1/2001 | Garofano et al. | D28/7 |
| D439,705 | S | 3/2001 | Lerolle | D28/76 |
| D448,121 | S | 9/2001 | Gebb et al. | D28/88 |
| 6,375,375 | B1 | 4/2002 | Gebb et al. | 401/194 |
| D464,773 | S | 10/2002 | Fischer et al. | D28/77 |
| D469,694 | S | 2/2003 | Lerolle | D9/522 |
| 6,669,389 | B2 | 12/2003 | Gueret | 401/122 |
| D491,691 | S | 6/2004 | Braaten et al. | D28/76 |
| D502,572 | S | 3/2005 | Dumler et al. | D28/76 |
| D503,244 | S | 3/2005 | Campbell et al. | D28/76 |
| D521,383 | S | 5/2006 | Priestman | D9/529 |
| D521,384 | S | 5/2006 | Priestman | D9/529 |
| D521,385 | S | 5/2006 | Priestman | D9/529 |
| D523,179 | S | 6/2006 | Py et al. | D28/88 |
| D526,205 | S | 8/2006 | Priestman | D9/529 |
| D527,269 | S | 8/2006 | Priestman | D9/529 |
| 2005/0183737 | A1 | 8/2005 | Dumler | 132/317 |
| 2006/0065282 | A1 | 3/2006 | Hartstock et al. | 132/320 |

FOREIGN PATENT DOCUMENTS

| | | |
|---|---|---|
| CN | 2358745 | 1/2000 |
| CN | 2704248 | 6/2005 |
| EM | 000349378-003 | 9/2005 |
| EM | 360755-0001 | 10/2005 |
| GB | 604 534 | 7/1948 |
| JP | 2002-326491 | 11/2002 |
| JP | D1263549 | 2/2006 |
| TW | 245431 | 4/1995 |
| TW | D105005 | 6/2005 |

OTHER PUBLICATIONS

International Search Report and Written Opinion, issued in PCT/US2007/088713, dated Jul. 24, 2008.

Office Action, issued in Chinese Patent Application No. 200780047428, dated Jul. 2, 2010 (English translation).

Office Action, issued in Chinese Patent Application No. 200780047428, dated Oct. 13, 2010 (English translation).

Office Action, issued in Chinese Patent Application No. 200780047428, dated Apr. 8, 2011 (English translation).

Office Action, issued in Chinese Patent Application No. 200780047428, dated Jul. 19, 2011 (English translation).

Office Action, issued in Russian Design Application No. 2007502088, dated Mar. 18, 2008 (English translation).

Office Action, issued in U.S. Appl. No. 11/750,546, dated Jul. 16, 2010.

Office Action, issued in U.S. Appl. No. 11/750,546, dated Sep. 24, 2010.

Office Action, issued in U.S. Appl. No. 11/750,546, dated Apr. 18, 2011.

Office Action, issued on ROC (Taiwan) Patent Application No. 096302609, dated Mar. 3, 2008 (English translation).

Office Communication, issued in U.S. Appl. No. 29/275,360, dated Nov. 14, 2007.

COSMETIC CONTAINER WITH COLOR INSERT

RELATED APPLICATIONS

This application is a continuation of U.S. patent application Ser. No. 11/750,546, filed May 18, 2007 (now issued U.S. Pat. No. 8,083,427), which claims priority to U.S. patent application Ser. No. 29/275,360, filed Dec. 21, 2006 (now issued U.S. Pat. No. D565,797). The contents of the referenced applications are incorporated by reference.

BACKGROUND OF THE INVENTION

1. Field of the Invention

Embodiments of the present invention relate generally to containers for holding cosmetic products. More particularly, embodiments of the present invention relate to containers for holding cosmetic products such as lipstick.

2. Description of Related Art

Cosmetic containers such as lipstick cases typically consist of a base and a cap encasing a lipstick tube or cartridge. If a user desires to determine the color of the lipstick, the user is typically required to remove the cap from the cartridge and base and visually inspect the color of the lipstick. In some instances, the lipstick may be recessed or retracted in a cartridge so that visual inspection is not easily accomplished simply by removing the cap. For example, if a significant portion of the lipstick has been removed during previous applications, merely removing the cap may not provide adequate visual access to the lipstick for an accurate color determination. While the lipstick may be visible with the cap removed, the lipstick may be retracted in the cartridge to such a degree that there is insufficient light inside the cartridge to determine the lipstick color. In such cases, it may be necessary to manipulate the cartridge (typically by rotating a portion of the cartridge) to extend the lipstick from the cartridge.

Removing the cap and manipulating the cartridge to extend the lipstick is a relatively time-consuming task, especially if the process must be repeated for several cases in order to locate the desired lipstick color. In addition, removing the cap and extending the lipstick may unnecessarily expose the lipstick to the outside environment if the user determines that the lipstick is not the desired color. Such unnecessary exposure may have negative effects on the lipstick, including creating hygienic issues due to possible contamination of the lipstick (for example if the lipstick is dropped or comes into contact with a foreign particle while exposed). Repeated exposure of the lipstick may also lead to drying out the lipstick.

In certain instances, it may be desirable for a user to replace the lipstick cartridge within a specific case. For example, when the lipstick has been consumed or when the user desires to change lipstick colors, a user may wish to change lipstick cartridges within a specific case. This is particularly likely when the lipstick case is a decorative item rather than a disposable good. In such an instance, it would be desirable to provide an external visual indication of the color of the lipstick cartridge that is being replaced in the lipstick case.

Certain existing lipstick cases may provide a visual indication of the color of the lipstick contained within the case. However, these visual indicators are often adhesive labels that can be inadvertently removed from the lipstick case. In addition, other existing refillable lipstick cases do not have visual color indicators are interchangeable, so that a user cannot retain the existing case and replace the lipstick and the color indicator with a different color.

It is therefore desirable to provide a cosmetic container that overcomes the deficiencies noted in prior apparatuses and methods.

SUMMARY OF THE INVENTION

Embodiments of the present disclosure provide a container and method for holding cosmetic products. In one non-limiting embodiment of the present disclosure, the container comprises: an elongate body; a cosmetic product disposed within the elongate body, wherein the cosmetic product is a first color; an elongate cap comprising a first end and a second end, wherein the elongate body is configured to be inserted into the second end; an insert coupled to the elongate cap, wherein the insert is configured to indicate the first color of the cosmetic product. In certain embodiments, the cosmetic product is lipstick. In other embodiments, the cosmetic product may be a product other than lipstick. In certain embodiments, the insert is coupled to the elongate cap proximal to the first end. In particular embodiments, the insert is configured to be removed from the first end of the elongate cap by inserting an elongate instrument into the second end and applying a force against the insert with the elongate instrument.

Certain embodiments also comprise a replacement insert, wherein the replacement insert is configured to replace the insert and indicate a second color. Still other embodiments also comprise a replacement cosmetic product, wherein the replacement cosmetic product is the second color. In particular embodiments, the insert is retained in the first end of the elongate cap by a friction, interference, or snap fit. Certain embodiments comprise a first weight disposed in the elongate cap, and other embodiments further comprise a second weight disposed in the elongate body. In certain embodiments, the insert is flush with the first end of the elongate cap. In particular embodiments, the cap comprises a protrusion configured to engage the insert.

Other embodiments comprise: a generally cylindrical body containing a cosmetic product, wherein the cosmetic product is a first color; a generally cylindrical cap comprising a first end and a second end, wherein the second end is configured to engage the elongate body; and an insert coupled to the generally cylindrical cap, wherein the insert is a second color and wherein the first color and the second color are substantially similar.

In certain embodiments, the insert comprises a plurality of ribs that engage a plurality of slots in the generally cylindrical cap. In certain embodiments, the insert is coupled to the generally cylindrical cap proximal to the first end. Particular embodiments comprise a replacement insert and a replacement cosmetic product, wherein the replacement insert is a third color and the replacement cosmetic product is a fourth color and the third color and the fourth color are substantially similar.

Certain embodiments further comprise additional weights to increase the mass of container 100. In particular embodiments, the insert is configured to be removed from the first end of the generally cylindrical cap. In certain embodiments, the insert is molded from a uniform material. and the cross-section of the insert may be substantially a uniform color.

Other embodiments comprise a method of replacing a lipstick cartridge, the method comprising: removing a cap from lipstick container; removing a lipstick cartridge from the lipstick container; removing a colored insert from the cap; replacing the lipstick cartridge with a replacement lipstick cartridge; inserting a replacement colored insert into the cap; and replacing the cap on the lipstick container. In certain embodiments, the colored insert is substantially similar in color to a lipstick product in the lipstick cartridge. In particular embodiments, the replacement colored insert is substantially similar in color to a replacement lipstick product in the lipstick cartridge.

As used herein, the terms "a" and "an" are defined as one or more unless this disclosure explicitly requires otherwise.

The term "substantially" and its variations are defined as being largely but not necessarily wholly what is specified as understood by one of ordinary skill in the art, and in one non-limiting embodiment the term "substantially" refers to ranges within 10%, preferably within 5%, more preferably within 1%, and most preferably within 0.5% of what is specified.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more elements. Likewise, a step of a method or an element of a device that "comprises," "has," "includes" or "contains" one or more features possesses those one or more features, but is not limited to possessing only those one or more features. Furthermore, a device or structure that is configured in a certain way is configured in at least that way, but may also be configured in ways that are not listed.

The term "coupled," as used herein, is defined as connected, although not necessarily directly, and not necessarily mechanically Other features and associated advantages will become apparent with reference to the following detailed description of specific, example embodiments in connection with the accompanying drawings.

BRIEF DESCRIPTION OF THE DRAWINGS

The following drawings form part of the present specification and are included to further demonstrate certain aspects of the invention. The invention may be better understood by reference to one or more of these drawings in combination with the detailed description of example embodiments presented here. The drawings are not to scale, and certain distances or spacings may be exaggerated to provide clarity. The drawings are examples only. They do not limit the claims.

DESCRIPTION OF ILLUSTRATIVE EMBODIMENTS

Embodiments of this disclosure provide a method and apparatus for containing cosmetic products such as lipstick.

Figure 1:
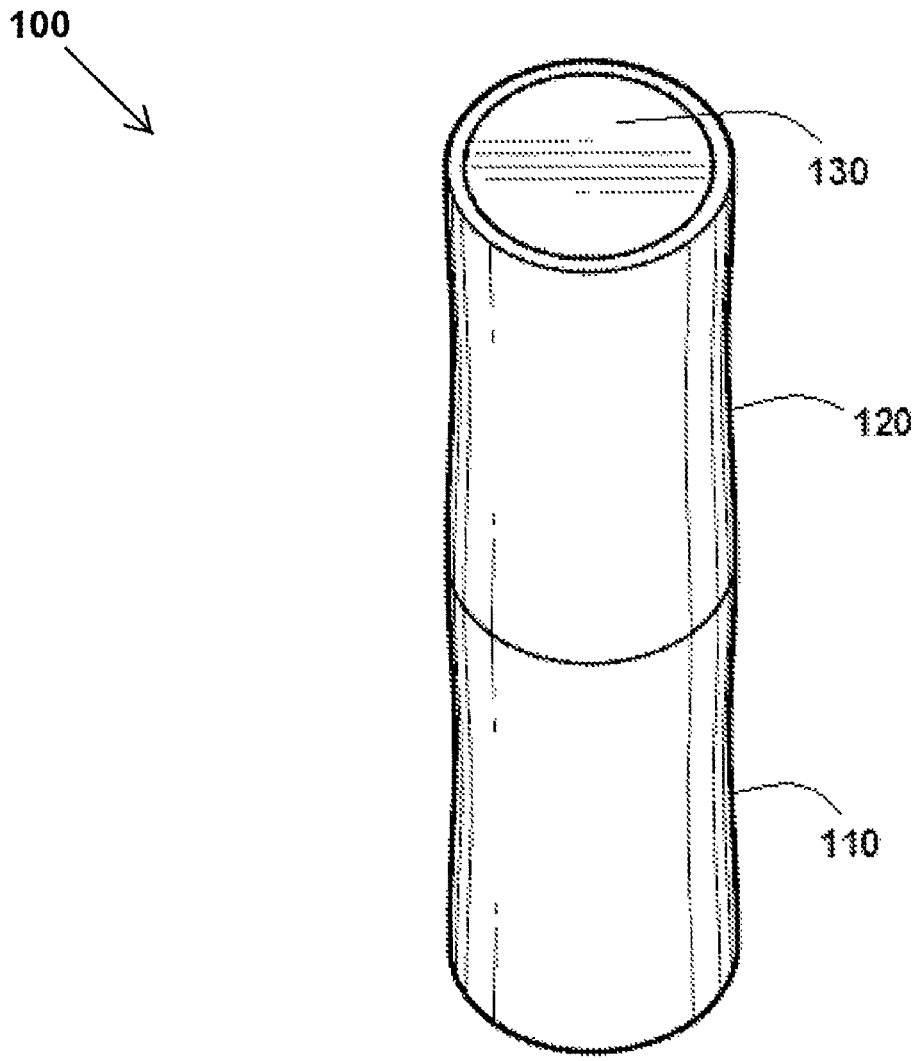
FIG. 1 is a perspective view of an assembled container, in accordance with embodiments of this disclosure.
Figure 2:
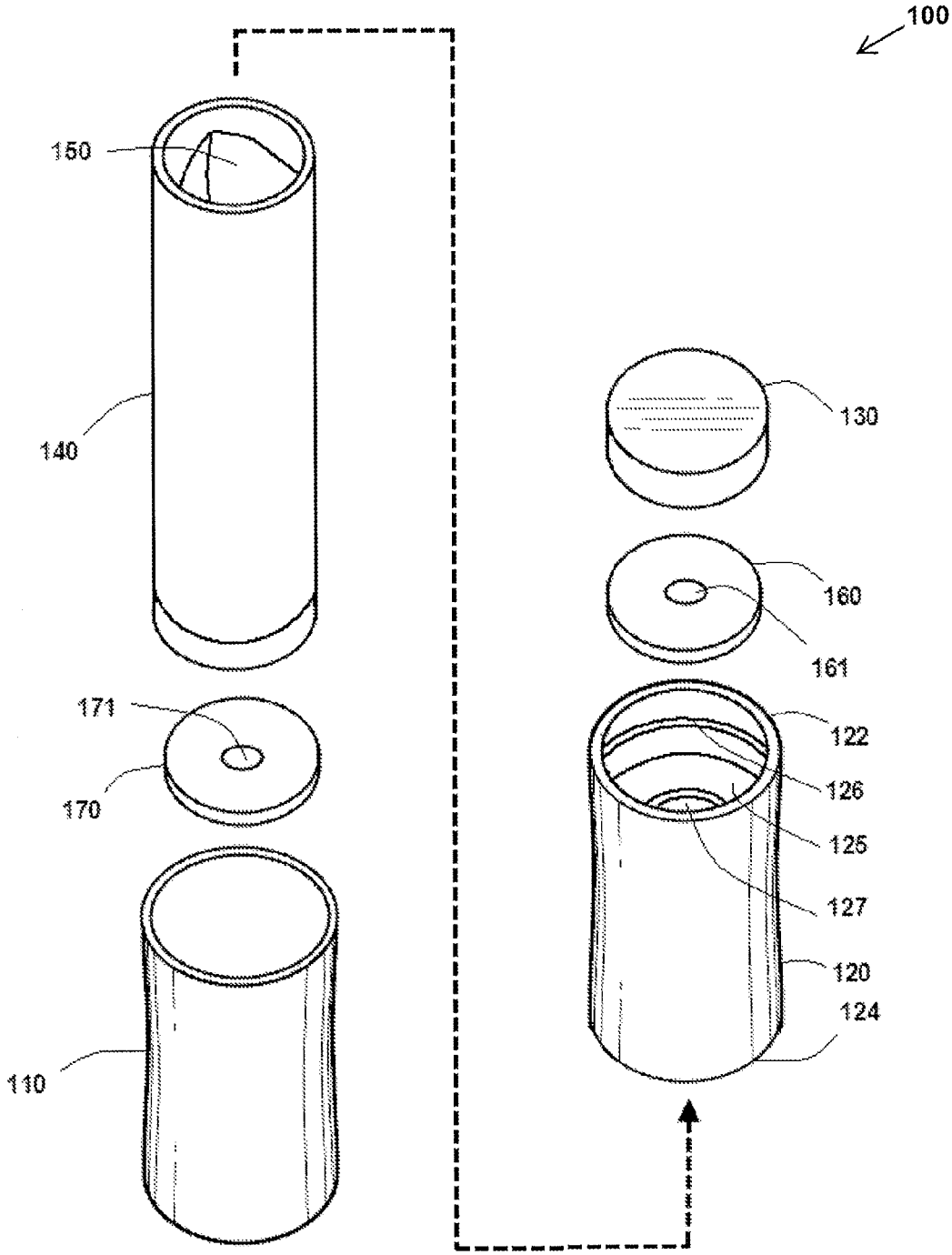
FIG. 2 is a perspective view of a container in an exploded position, in accordance with embodiments of this disclosure.

Referring initially to FIG. 1, a cosmetic container 100 is shown in an assembled view. FIG. 2 illustrates cosmetic container 100 in an exploded view so that internal components of cosmetic container are visible. In this embodiment, cosmetic container comprises a base, or elongate body, 110, a cap 120, an insert 130, a cartridge 140, a cosmetic product 150, a first weight 160 and a second weight 170.

As shown in FIG. 2, cosmetic container 100 can be assembled so that second weight 170 (with an aperture 171) and cartridge 140 are inserted into base 110. In the embodiment shown, cartridge 140 comprises cosmetic product 150, and cap 120 comprises a first end 122, a second end 124, a protrusion 126, and a support member 125. In certain embodiments, support member 125 is a wall protruding partially across the interior of cap 120 with an aperture 127 through support member 125.

The embodiment of FIGS. 1 and 2 also comprises a first weight 160 with an aperture 161 and an insert 130 inserted into first end 122 of cap 120. In this embodiment, support member 125 supports first weight 160, and insert 130 is retained in first end 122 by a friction or snap fit provided by protrusion 126. In this embodiment, protrusion 126 is a raised ridge that extends around the inner perimeter of cap 120 proximal to first end 122.

During assembly of the disclosed embodiment, cartridge 140 extends into second end 124 so that second end 124 engages base 110. As shown in FIG. 1, cosmetic product 150 is not visible when cosmetic container 100 is assembled. Therefore, without an external indication of the color of cosmetic product 150, a user would be required to remove cap 120 to examine cosmetic product 150 in order to determine the color of cosmetic product 150.

In the embodiment of FIGS. 1 and 2, insert 130 comprises a material that is substantially similar in color to cosmetic product 150. Therefore, a user of cosmetic container 100 can determine the color of cosmetic product 150 without removing cap 120 from base 110 and examining cosmetic product 150. In this manner, cosmetic container 100 can remain closed and still allow the user to determine the color of cosmetic product 150. In certain embodiments, the insert is molded from a uniform material.

In certain embodiments, insert 130 may be molded from a material that is substantially similar in color to cosmetic product 150. Such embodiments may provide benefits over other containers using other configurations, such as adhesive labels, to indicate color. For example, if insert 130 is uniform in color, a scratch to the surface of insert 130 will not change the color of insert 130. In addition, an adhesive label may become separated from the cap, thereby eliminating the ability to externally visually detect the color of the cosmetic product contained inside.

The embodiment shown in FIGS. 1 and 2 may therefore allow a user to more quickly determine the color of cosmetic product 150. In addition, the disclosed embodiment may provide hygienic benefits by reducing the frequency that cap 120 is removed from base 110 and cosmetic product 150 is exposed to the outside environment.

Furthermore, if cartridge 140 is replaced with another cartridge (not shown) containing a cosmetic product of a color different from cosmetic product 150, insert 130 can also be replaced with another insert (not shown) having a color corresponding to the replacement cosmetic product. In certain embodiments, a user may remove insert 130 from cap 120 by placing an elongate instrument (such as a pencil, not shown) in second end 124. The elongate object can be extended through apertures 127 and 161 and pressed against insert 130 so that insert 130 can be forced out of first end 122. A replacement insert (having a color corresponding to the replacement cosmetic product) may then be inserted into first end 122. In certain embodiments, a replacement cartridge and insert can be sold as a matched pair so that a user can replace both the cartridge and the insert at the same time.

Figure 3:
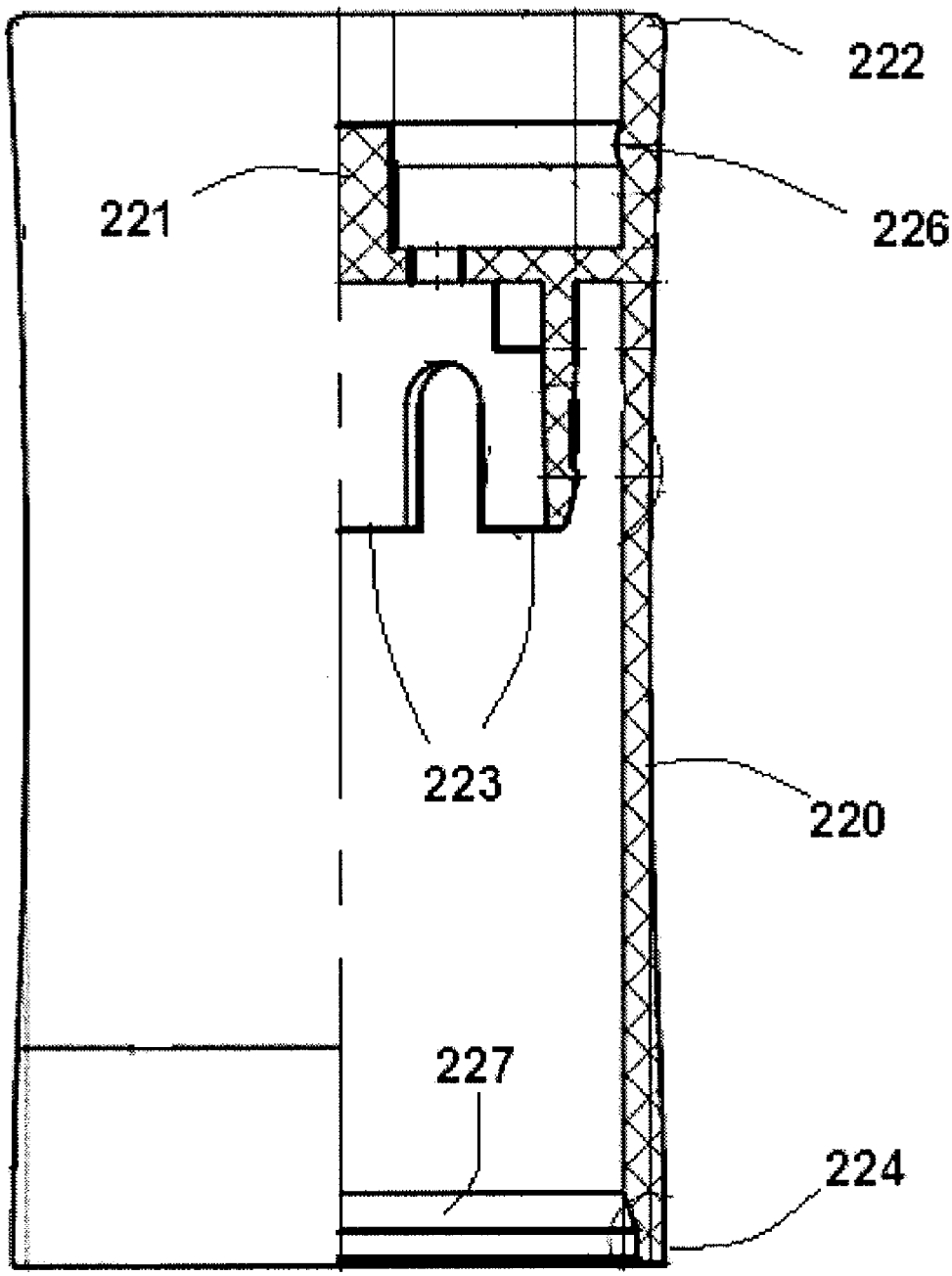
FIG. 3 is a partial cross section of a component of a container, in accordance with embodiments of this disclosure.
Figure 4:
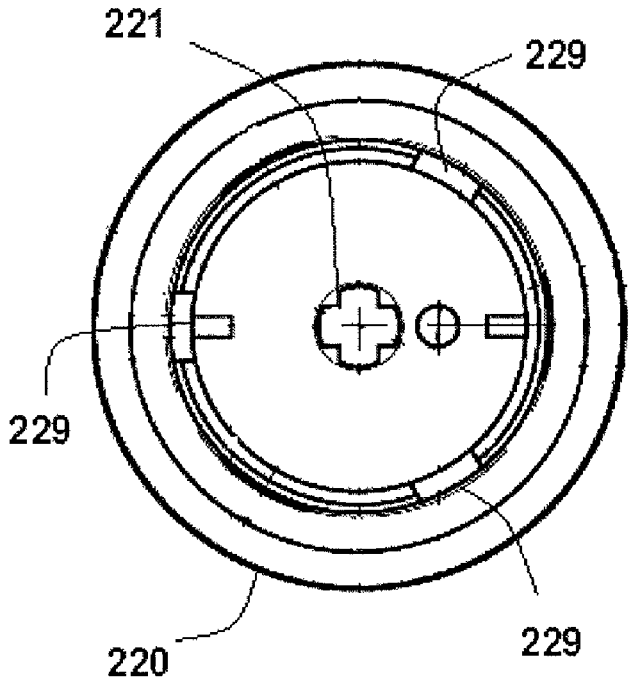
FIG. 4 is an end view of a component of a container, in accordance with embodiments of this disclosure.

In the embodiment shown, insert 130 is fully inserted into end 122 so that it is flush with end 122. In other embodiments, insert 130 may extend beyond end 122. In the embodiment of FIGS. 1 and 2, protrusion 126 provides a retention mechanism so that insert 130 is retained in cap 120 until a user desires to intentionally remove insert 130. Other embodiments may comprise different configurations that maintain a friction, interference, or snap fit. For example a partial section of another embodiment of a cap 220 is shown in FIG. 3 Cap 220 comprises a first end 222 and a second end 224. Cap 220 also comprises a center post 221 and ribs 223 in the interior of cap 220 in addition to a protrusion 226. As shown in the end view of FIG. 4, cap 220 also comprises a series of recesses or slots 229 distributed around the perimeter of cap 220. In this embodiment, end 224 comprises a relief 227 configured to engage a base (not shown).

Figure 5:
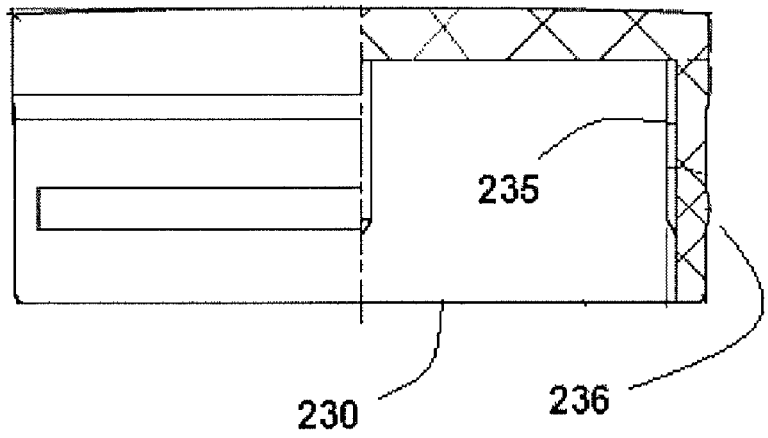
FIG. 5 is a partial cross section of a component of a container, in accordance with embodiments of this disclosure.

A partial cross section of another embodiment of an insert 230 is shown in FIG. 5. This embodiment comprises a protrusion 236 on a rib 235. In certain embodiments, protrusion 236 can extend past protrusion 226 in cap 220 to provide a snap fit. Rib 235 may flex to aid in the insertion or removal of insert 230 into end 222 of cap 220. In certain embodiments, rib 235 may engage recess 229 of cap 220.

The embodiment of FIGS. 1 and 2 also comprises first weight 160 and second weight 170 to add weight to cosmetic container 100. Increasing the weight of cosmetic container 100 improves the tactile qualities of cosmetic container 100. However, certain embodiments may not have additional weights used to increase the weight of the cosmetic container.

What is claimed is:

1. A container for holding a lipstick comprising:

an elongate body;

a lipstick disposed within the elongate body, wherein the lipstick is a first color;

an elongate cap comprising a first end and a second end, wherein the elongate body is configured to be inserted into the second end, and wherein the elongate cap is opaque; and an insert coupled to the elongate cap, wherein the insert is opaque and is configured to indicate the first color of the lipstick, and wherein the insert does not extend beyond the first end of the elongate cap.

2. The container of claim 1, wherein the insert is coupled to the elongate cap proximal to the first end.

3. The container of claim 1 wherein the insert is configured to be removed from the first end of the elongate cap by inserting an elongate instrument into the second end and applying a force against the insert with the elongate instrument.

4. The container of claim 1, further comprising a replacement insert, wherein the replacement insert is configured to replace the insert and indicate a second color.

5. The container of claim 4, further comprising a replacement lipstick, wherein the replacement lipstick is the second color.

6. The container of claim 1, wherein the insert is retained in the first end of the elongate cap by a friction, interference, or snap fit.

7. The container of claim 1, wherein the cap comprises a protrusion configured to engage the insert.

8. The container of claim 1 wherein the insert comprises a plurality of ribs that engage a plurality of slots in the elongate cap.

9. The container of claim 1 wherein the insert is molded from a uniform material.

10. The container of claim 1 wherein a cross-section of the insert is substantially a uniform color.

* * * * *

UNITED STATES PATENT AND TRADEMARK OFFICE

CERTIFICATE OF CORRECTION

PATENT NO. : 8,197,151 B2
APPLICATION NO. : 13/302737
DATED : June 12, 2012
INVENTOR(S) : Timothy Maddy It is certified that error appears in the above-identified patent and that said Letters Patent is hereby corrected as shown below:

In title page, item (63) Related U.S. Application Data, line 2, after "8,083,427" insert --, which is a continuation-in-part of application No. 29/275,360, filed on Dec. 21, 2006, now Pat. No. Des. 565,797--.

Signed and Sealed this
Fourteenth Day of August, 2012

David J. Kappos

David J. Kappos
*Director of the United States Patent and Trademark Office*